US006257014B1

(12) United States Patent
Jao

(10) Patent No.: US 6,257,014 B1
(45) Date of Patent: Jul. 10, 2001

(54) AIR CONDITIONER ARRANGEMENT

(76) Inventor: Chiu Chin Jao, 1-7, Shih Lei Chuen, Shin Wu Shiang, Taur Yuan Shiann (TW)

( * ) Notice: Subject to any disclaimer, the term of this patent is extended or adjusted under 35 U.S.C. 154(b) by 0 days.

(21) Appl. No.: 09/411,247

(22) Filed: Oct. 4, 1999

(51) Int. Cl.[7] ..... F25B 13/00

(52) U.S. Cl. ..... 62/324.6; 62/524; 62/525; 62/527; 62/515

(58) Field of Search ..... 62/527, 515, 524, 62/324.6, 525

(56) References Cited

U.S. PATENT DOCUMENTS 3,563,055 * 2/1971 Owens ..... 62/525
4,123,914 * 11/1978 Perez et al. ..... 62/196
4,340,404 * 7/1982 Oonishi et al. ..... 62/198
4,741,178 * 5/1988 Fujiu et al. ..... 62/525
5,465,591 * 11/1995 Cur et al. ..... 62/439
5,842,351 * 12/1998 Earhart, Jr. ..... 62/117
5,927,093 * 7/1999 Noguchi et al. ..... 62/259.1
5,987,916 * 11/1999 Egbert ..... 62/498
6,105,387 * 8/2000 Hong et al. ..... 62/524

* cited by examiner

*Primary Examiner*—William Doerrler
*Assistant Examiner*—Mark Shulman
(74) *Attorney, Agent, or Firm*—Bacon & Thomas PLLC

(57) ABSTRACT

An air conditioner arrangement including an outer air conditioner. The air conditioner includes a compressor for compressing a refrigerant and connections for transporting the refrigerant to at least two indoor air conditioners for heat transfer. Between the compressor and each respective indoor air conditioners is provided a main injection tube, and an expansion chamber is connected to the main injection tube. The main injection tube is inserted into the expansion chamber. The expansion chamber has an inlet which is connected with a common cycling tube. When one or more of the indoor air conditioners is shut off or stopped because the temperature in one of the rooms have reached a preset degree, the compressor can divert excess refrigerant to other indoor air conditioners that are still operating, so that the other rooms can quickly reach their preset temperature or comfort zone.

2 Claims, 2 Drawing Sheets

AIR CONDITIONER ARRANGEMENT

BACKGROUND OF THE INVENTION

1. Field of the present Invention

The present invention relates to an air conditioner arrangement, and more particularly to an air conditioner arrangement for multiple rooms, comprising an outdoor air conditioner having a single compressor communicating with at least two indoor air conditioners.

2. Description of the Related Art

The conventional air conditioner arrangement has two major different models according to the different functions of the air conditioner. First kind of air conditioner arrangement is the one to one model, which comprises one outdoor air conditioner connected to one indoor air conditioner. Second kind of air conditioner arrangement is the multiple model, which comprises one outdoor air conditioner communicating with at least two indoor air conditioners. The outdoor air conditioner of the one to multiple model further has two different types. First, a single outdoor air conditioner comprises multiple compressors that serve for multiple indoor air conditioners respectively. Second, a single outdoor air conditioner comprises a single compressor that serve at least two indoor air conditioners.

The above described air conditioner arrangement, which comprises a single outdoor air conditioner having a single compressor at least two indoor air conditioners, has drawbacks. Conventionally, when one of the multiple indoor air conditioners is shut off or the room temperature is lowered to a predetermined temperature, the extra refrigerant such as freon is recycled back to the compressor. However, since the single compressor needs to satisfy the multiple indoor air conditioners simultaneously, the cooling ability for each indoor air conditioner is at different magnitudes. Also the cooling output put out by the compressor to each indoor air conditioner is fixed, so the compressor must continue to work until the temperature of every room that the indoor air conditioners to which it is installed respectively is lowered to the predetermined temperature. Therefore, by shutting off one of the indoor air conditioners would not save any energy or increase the cooling ability of other indoor air conditioners in other rooms.

SUMMARY OF THE PRESENT INVENTION

The main objective of the present invention is to provide an air conditioner arrangement, which comprises an outdoor air conditioner having a single compressor communicating with at least two indoor heat exchangers, in which when one or more of the indoor heat exchangers is are shut off or stopped because the room temperature has been lowered to a predetermined temperature, the cooling ability of the other operating indoor heat exchanges are increased, so that the temperature of the rooms that the other indoor heat exchanges are installed will be accelerated to reach the predetermined temperature.

Accordingly, the present invention provides an air conditioner arrangement comprising an outdoor air conditioner and at least two indoor heat exchanges. The outdoor air conditioner comprises at least a compressor for compressing and transporting refrigerant to the indoor heat exchanges to have heat transfer. Between the compressor and each respective indoor heat exchanges, at least a main injection tube and an expansion chamber that are connected to the main injection tube are provided. A common cycling tube communicates with every expansion chambers. The main injection tube is throughout the common cycling tube and is inserted into the expansion chamber with a predetermined distance.

DETAILED DESCRIPTION OF THE PREFERRED EMBODIMENT

Figure 1:
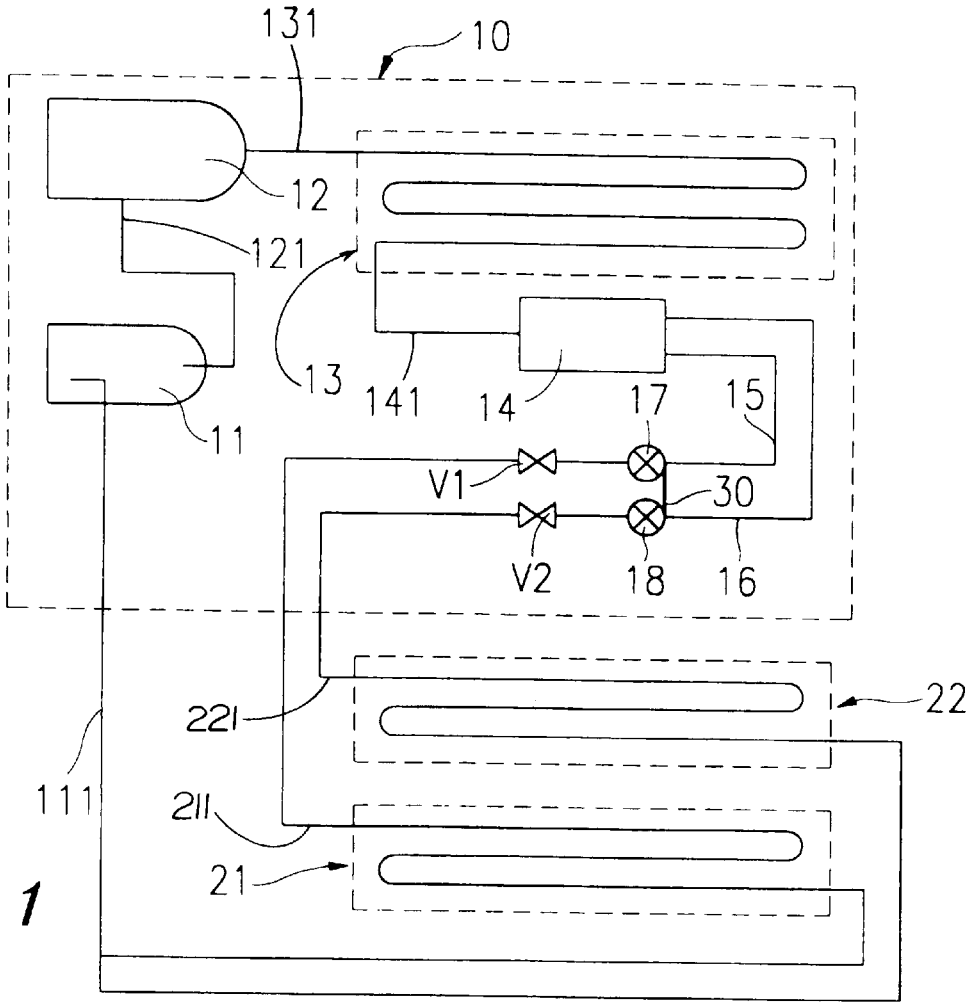
FIG. 1 is a schematic view of an air conditioner arrangement according to a first preferred embodiment of the present invention, in which an outdoor air conditioner is connected with two corresponding indoor heat exchangers.
Figure 2:
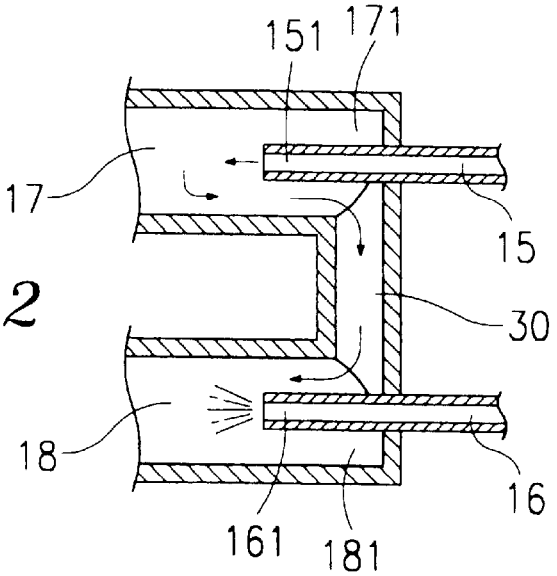
FIG. 2 is partial sectional view illustrating a common cycling tube connected between two expansion chambers of the air conditioner arrangement according to the above first preferred embodiment of the present invention.

Referring to FIGS. 1 and 2 of the drawings, a first preferred embodiment of the present invention of an air conditioner arrangement is illustrated. The air conditioner arrangement comprises an outdoor air conditioner 10, a first indoor heat exchanger 21 and a second indoor heat exchanger 22. The outdoor air conditioner 10 comprises a accumulator 11 for collecting a cycling refrigerant, such as freon, from the first and second indoor heat exchangers 21, 22 by a collecting conduit 111 connected to the first and second indoor heat exchangers 21, 22. A compressor 12 is connected to the accumulator 11 by a connecting conduit 121 for compressing the refrigerant. A condenser 13 is connected to the compressor 12 by a condensing conduit 131. A dessicator 14 is connected to the condenser 13 by a dessicating conduit 141. First and second maim injection tubes 15, 16 are connected from the dessicator 14 to a first and a second expansion chamber 17, 18 respectively. First and second control valves V1, V2 are connected to the first and second expansion chamber 17, 18 respectively. The first and second indoor heat exchanger 21, 22 are connected to the first and second control valve V1, V2 by a first and a second conduit 211, 221 respectively. The first and second expansion chamber 17, 18 are further connected by a common cycling tube 30 which is positioned between at the first and second expansion chamber inlets 171, 181. The first and second main injection tube 15, 16 have a first and a second main injection outlet 151, 161 in communication with the common cycling tube 30 and inserted into the first and second expansion chamber 17, 18 respectively.

Referring to FIG. 2, during the stage that the first and second main injection outlet tubes 151, 161 inside of the first and second expansion chambers 17, 18 are outletting refrigerant, the surroundings of the first and second main injection outlets 151, 161 are in a vacuum stage of low pressure. When the first indoor heat exchanger 21 is shut off, or when the predetermined room temperature is reached, the first control valve V1 would be shut off to stop providing the refrigerant. The second expansion chamber inlet 181 would withdraw the excess refrigerant out of the first expansion chamber 17 from the first expansion chamber inlet 171 via the common cycling tube 30. In other words, when the first control valve V1 is shut off, the original refrigerant providing for the first indoor heat exchanger 21 would be directed to fill the second expansion chamber 18 and provide the second indoor heat exchanger 22 with refrigerant via the second control valve V2 so as to increase the cooling ability of the second indoor heat exchanger 22, such that, the second indoor heat exchanger 22 would be able to provide a cooler room temperature in a shorter time and thus effectively saves the energy source.

Figure 3:
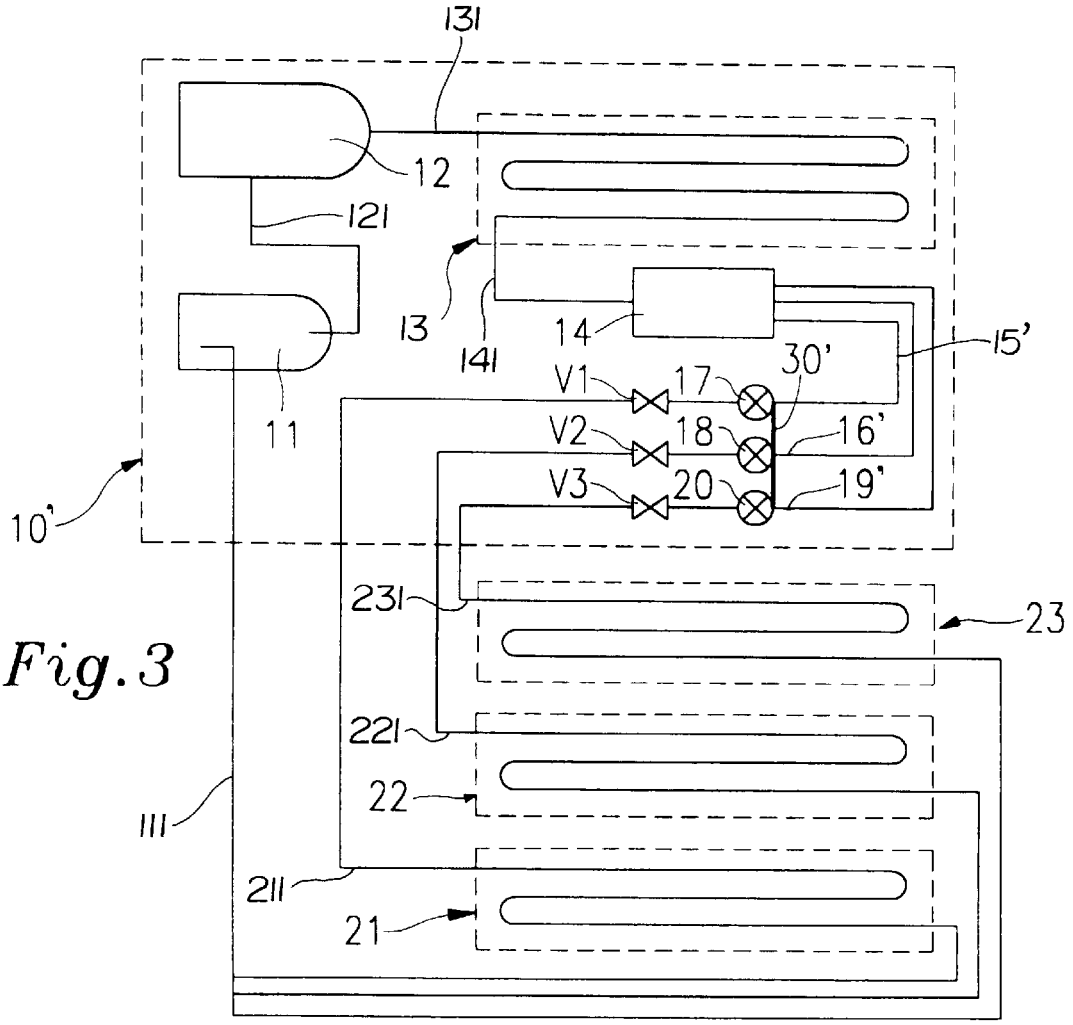
FIG. 3 is a schematic view of an air conditioner arrangement according to a second preferred embodiment of the present invention, in which an outdoor air conditioner is connected with three corresponding indoor heat exchangers.
Figure 4:
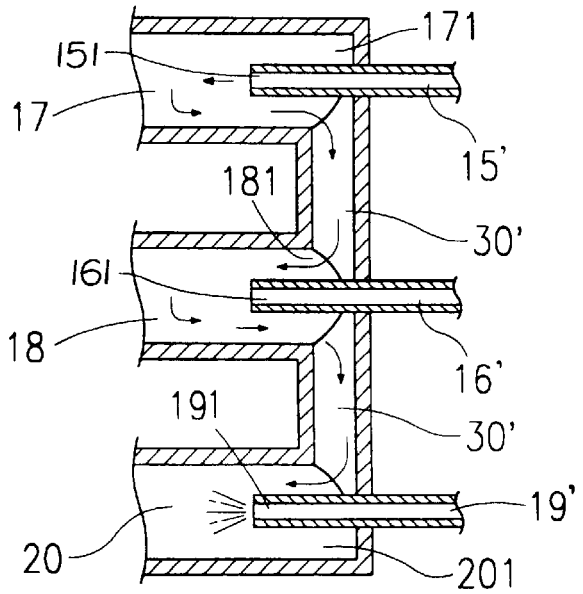
FIG. 4 is partial sectional view illustrating common cycling tube connected between three expansion chambers of the air condition arrangement according to the above second preferred embodiment of the present invention.

Referring to FIGS. 3 and 4 of the drawings, an air conditioner arrangement according to a second preferred embodiment of the present invention is illustrated. The air conditioner arrangement of the second preferred embodiment embodies how to communicate one compressor of an outdoor air conditioner 10' with more than two (three in this embodiment ) indoor heat exchangers 21, 22, 23. The outdoor air conditioner arrangement 10' is similar to the outdoor air conditioner arrangement 10 of above disclosed first embodiment, that also comprises a accumulator 11, a compressor 12 connected to the accumulator 11, a condenser 13 connected to the compressor 12, a dessicator 14 connected to the condenser 13, a first and a second main injection tube 15, 16 extended from the dessicator 14 to a first and a second expansion chamber 17, 18 respectively, and a first and a second control valve V1, V2 connected between the first and second expansion chamber 17, 18 and the first and second indoor heat exchangers 21, 22 respectively. According to the second preferred embodiment, an additional third main injection tube 19'with a third main injection outlet is also extended from the dessicator 14 to a third expansion chamber 20 which is further connected to the third indoor heat exchanger 23 through a third control valve V3 and a third conduit 231. The first , the second and the third expansion chambers 17, 18, 20 are further connected with a common cycling tube 30' which positioned at the first, second, and third expansion chamber inlets 171, 181, 201.

As shown in FIG. 4, the first, second, and third main injection tubes 15, 16, 19 comprise a first, a second and a third main injection outlets 151, 161, 191, each respectively in communication with the common cycling tube 30' and inserting into the first, the second and the third expansion chambers 17, 18, 20.

When one or two indoor heat exchangers, for example the first and second indoor heat exchangers, 21, 22 are shut off or their predetermined room temperatures have been reached, the control valves V1, V2 are shut off and the refrigerant which is originally supplied to the first and second expansion chambers 17, 18 will be directed to third expansion chamber 20 via the first and second expansion chamber inlets 171, 181 and the common cycling tube 30' due to the vacuum a the first and second main injection outlets 151, 161. Therefore, the cooling ability of the third indoor heat exchanger 23 is enhanced, and would be able to provide a cooler room temperature in a shorter time and thus effectively save energy source.

By means of this principle, a single outdoor air conditioner having only a single compressor can also be communication with four or more indoor heat exchangers in the air conditioner arrangement system.

What is claimed is:

1. An air conditioner arrangement, comprising at least a first and a second indoor heat exchanger; and an outdoor air conditioner, comprising an accumulator for collecting a refrigerant from said first and second indoor heat exchangers;

a compressor which is connected to said accumulator via a connecting conduit for compressing said refrigerant from said accumulator;

a condenser which is connected to said compressor via a condensing conduit;

a dessicator which is connected to said condenser via a dessicating conduit;

at least a first and a second expansion chamber which are connected with said dessicator by a first and a second main injection tube respectively, said first and second expansion chambers having respective first and second expansion chamber inlets which are connected with a common cycling tube, said first and second main injection tubes being extended from said dessicator to said first and second expansion chambers respectively, said first main injection tube having a first main injection outlet throughout said common cycling tube and inserted into said first expansion chamber and said second main injection tube having a second main injection outlet throughout said common cycling tube and inserted into said second expansion chamber; and a first and a second control valve, which are respectively connected to said first and second expansion chambers, being connected to said first and second indoor heat exhangers via a first and a second conduit respectively.

2. The air conditioner arrangement, as recited in claim 1, further comprising a third indoor heat exchanger;

a third expansion chamber which is connected to said third indoor heat exchanger via a third conduit, said third expansion chamber also having a third expansion chamber inlet which is connected with said common cycling tube;

a third control valve connecting between said third expansion chamber and said third indoor heat exchanger;

a third main injection tube extended from said dessicator to said third expansion chamber, said third main injection tube also having a third main injection outlet throughout said common cycling tube and inserted into said third expansion chamber.

* * * * *